US007603991B2

(12) United States Patent
Rozim

(10) Patent No.: US 7,603,991 B2
(45) Date of Patent: Oct. 20, 2009

(54) METHOD AND EQUIPMENT FOR REDUCING EMISSION AND FUEL CONSUMPTION IN ORDER TO IMPROVE COMBUSTION IN INTERNAL COMBUSTION ENGINES

(76) Inventor: Peter Rozim, Kertalja ut 32, 3300 Eger (HU)

( * ) Notice: Subject to any disclaimer, the term of this patent is extended or adjusted under 35 U.S.C. 154(b) by 9 days.

(21) Appl. No.: 10/562,364

(22) PCT Filed: Jan. 27, 2004

(86) PCT No.: PCT/HU2004/000011

§ 371 (c)(1),
(2), (4) Date: Feb. 7, 2007

(87) PCT Pub. No.: WO2005/001274

PCT Pub. Date: Jan. 6, 2005

(65) Prior Publication Data

US 2007/0272220 A1 Nov. 29, 2007

(30) Foreign Application Priority Data

Jun. 30, 2003 (HU) ..... P0302008

(51) Int. Cl.
*F02M 27/04* (2006.01)

(52) U.S. Cl. ..... 123/536

(58) Field of Classification Search ..... 123/536–539
See application file for complete search history.

(56) References Cited

U.S. PATENT DOCUMENTS 3,857,375 A * 12/1974 Jackson ..... 123/587
3,878,469 A * 4/1975 Bolasny ..... 250/423 R
4,237,836 A * 12/1980 Tanasawa et al. ..... 123/472
4,344,404 A * 8/1982 Child et al. ..... 123/538
5,362,179 A * 11/1994 Sirovich et al. ..... 138/37
5,992,397 A * 11/1999 Hideaki et al. ..... 123/538

FOREIGN PATENT DOCUMENTS

JP 01232156 A * 9/1989

* cited by examiner

*Primary Examiner*—M. McMahon
(74) *Attorney, Agent, or Firm*—Raggio & Dinnin, P.C.

(57) ABSTRACT

A method and an equipment for reducing emission and fuel consumption in order to improve combustion in internal combustion engines, whereas, in order to achieve perfect combustion, prior to its entry into the combustion chamber of the internal combustion engine, the mixture of fuel and air is led through a treatment area characterized by specific physical properties, so as to provide, by applying high voltage, the air stream a charge of first polarity and the fuel stream a charge of opposite polarity and simultaneously vibrating at least one of the air and the fuel stream by a frequency in the ultrasonic range, in given cases in several, succA method and an equipment for reducing emission and fuel consumption in order to improve combustion in internal combustion engines, whereas, in order to achieve perfect combustion, prior to its entry into the combustion chamber of the internal combustion engine, the mixture of fuel and air is led through a treatment area characterized by specific physical properties, so as to provide, by applying high voltage, the air stream a charge of first polarity and the fuel stream a charge of opposite polarity and simultaneously vibrating at least one of the air and the fuel stream by a frequency in the ultrasonic range, in given cases in several, successive and/or parallel sections.

7 Claims, 3 Drawing Sheets

Figure 1:
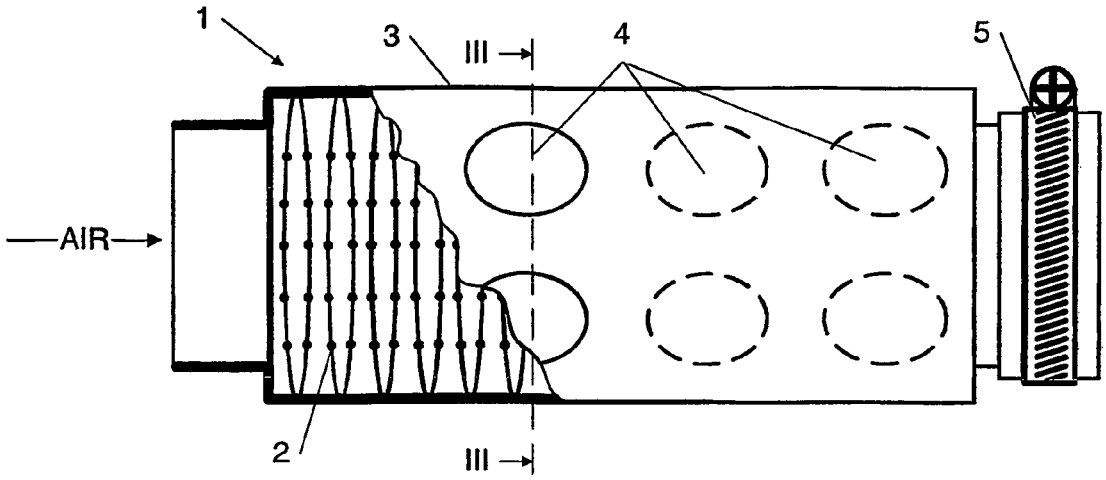

METHOD AND EQUIPMENT FOR REDUCING EMISSION AND FUEL CONSUMPTION IN ORDER TO IMPROVE COMBUSTION IN INTERNAL COMBUSTION ENGINES

The present invention relates, on the one hand, to a method for reducing emission and fuel consumption in order to improve combustion in internal combustion engines, whereas, in order to achieve perfect combustion, prior to its entry into the combustion chamber of the internal combustion engine, the mixture of fuel and air is led through a treatment area characterised by specific physical properties, so as to provide, by applying high voltage, the air stream a charge of first polarity and the fuel stream a charge of opposite polarity. The present invention relates, on the other hand, to an equipment for reducing emission and fuel consumption in order to improve combustion in internal combustion engines, whereas the said equipment comprises a first ionising unit providing the air stream with a first polarity charge and a second ionising unit providing the fuel stream a charge of opposite polarity, applicable for internal combustion, Otto, diesel and Wankel engines driven by liquid (petrol, gas oil) or gaseous (propane-butane) hydrocarbon.

The two major problems involved are the reduction of environmental hazards and of hydrocarbon consumption, respectively. Vehicles, machinery and equipment driven by internal combustion engine imply the highest degree of air, soil and water pollution. At the same time, they are also the biggest hydrocarbon consumers.

Given the increasing stringency of environmental protection regulations, including, among others, the Kyoto Agreement, and the finite nature of available hydrocarbon fuel resources, all industries manufacturing air, ground and water vehicles and machinery and equipment operating with internal combustion engine, aim, primarily, at preserving the engine output of internal combustion engines manufactured by them, while reducing, to the extent of the feasible, their hazardous waste emission and keeping level or, if possible, improving, their output, while reducing fuel consumption. Consequently, in motorcar, aircraft, ship manufacture and engineering, the plan targets are inversely proportional: to reduce emission to the minimum, but to raise the output while reducing the energy input.

This is feasible both theoretically and in practice by improving combustion taking place in internal combustion engines propelled by hydrocarbon derivatives.

As is well known, as a result of imperfect combustion, 20-30% only of the fuel fed to internal combustion engines is utilised, while the remaining 70-80% exits the internal combustion engine as non-combusted hydrocarbon (HC), i.e. as lost energy and a substance damaging the environment.

Such injurious substances include carbon monoxide (CO) and carbon dioxide ($CO_2$). Of the two, carbon monoxide (CO), highly dangerous to the living organism, is the most hazardous. Carbon monoxide (CO) is the residue of the non-combusted hydrocarbon compound and, since in the case of carbon monoxide one carbon atom is bonded to one oxygen only and the carbon atom has two free electrons, it shall bond to one more oxygen atom.

If carbon monoxide (CO) enters the human organism, it abstracts the missing oxygen from that.

If, on the other hand, it remains in the air and reaches the ozone layer, it supplements the missing oxygen from the ozone. This is even worse, as the ozone is not a stable gas and hence it disintegrates very easily. Given its extremely high oxidising capacity, it oxidises carbon monoxide (CO), which becomes carbon dioxide ($CO_2$), while the ozone turns into oxygen. This process enhances global warming by continuously reducing the thickness of the ozone layer. The function of the ozone layer, on the other hand, is to prevent that ultraviolet radiation enters the atmosphere of the Earth.

Hence the solution to reducing the fuel consumption and the hazardous waste emission of internal combustion engines still driven by traditional hydrocarbon fuels (petrol, gas oil, gas etc.), without any negative change in the output of the internal combustion engine or, on the contrary, to reducing consumption while improving the output and, at the same time, conforming to the most stringent environmental protection regulations applicable to the emission of internal combustion engines, lies in the improvement of combustion efficiency.

Numerous solutions have been piloted the world over to enhance the efficiency of internal combustion engines, from solutions based on the transformation of the cylinder and/or the piston to solutions aiming at oxidising in one way or another part of the non-combusted 70-80% fuel in the cylinder area and hence producing extra output at reduced fuel consumption.

Generally, components homogenising the mixture have been used in the carburettor of two-stroke vehicles or older, more obsolete ones or in the inlet throat of vehicles operating with fuel injection. The said homogenising components include perforated sheets, filters or specially designed baskets (see HU 185 812). Alternatively, various elements guiding the mixture may be used. Such guide elements are described e.g. in HU 188 765.

Several patent specifications describe the application of permanent magnets in the fuel supply pipe as a possible way of efficiency enhancement. Such solutions are described under U.S. Pat. Nos. 4,278,549 and 4,605,498, respectively. In the first case, the magnets are arranged in the pipe; in the second case, the magnets are arranged on the pipe. In both cases, the fuel flows between the northern and southern pole of the magnets. The authors of the said solution based its effect mechanism on the assumption that air oxygen molecules sucked in by the engine shall adhere better to fuel led through a magnetic field.

For, efficiency enhancement is attainable, decisively, by increasing the surfaces of the fuel molecules coming into contact with oxygen promoting combustion. This improves combustion efficiency. In the known methods of carburation, however, the giant fuel molecules get recombined while flowing into the combustion chamber of the engine, and hence this method of enhancing combustion efficiency is not effective enough. Permanent magnets are applied to hinder the recombination of the giant molecules and hence promote the formation of small-size fuel drops with a relatively larger surface area in order to exert a positive influence on the combustion processes.

Nevertheless, neither efficiency improving instruments including mechanical magnets, nor those including permanent ones have resulted in significant fuel savings or have spread in practice. A further disadvantage of the said instruments is that they can be fitted exclusively to obsolete carburettor- or central-injection-based internal combustion engines.

In internal combustion engines manufactured with up-to-date technology and incorporating the most recent technical solutions, fuel enters each cylinder by direct injection. This has improved combustion in the cylinder area, and the use of catalyst appliances has reduced emission to a significant extent. In order to achieve the said results, a brand new type of engine had to be developed, allowing the more economical operation of motor vehicles, and a highly expensive catalyst appliance had to be installed into the exhaust system of the motor vehicle.

The above solutions, however, still fail to ensure full conformity with the increasingly stringent and demanding energy utilisation and environmental protection requirements. Owing to what is codified under the Kyoto Agreement, it is considered more important today to reduce the hazardous waste emission of internal combustion engines than to reduce their fuel consumption. This applies to vehicles and machinery fitted with internal combustion engines driven by either petrol or diesel oil.

Therefore, the objective of the present invention was to work out a solution allowing to improve mix formation in internal combustion engines by efficiently enhancing the bonding between the hydrocarbon molecules and the oxygen molecules of the air, hence improving the quality of combustion taking place within the cylinder, with the direct consequence of reduced emission and fuel consumption. The author's intention was to device a solution including no moving part, based on up-to-date electronics, but on a simple and logical theory, suitable for easy fitting without serious transformation in both new and already operating engines, from the most modern ones (using direct injection) to the obsolete (carburettor-based) two- and four-stroke petrol-driven Otto engines, diesel engines working with gas oil, gas-driven engines working with propane-butane gas, Wankel engines and all other further engines or combustion works/furnaces oxidising liquid or gaseous fuel with the help of oxygen in the air in the internal combustion area.

The main energy-containing elements of fuels driving internal combustion engines are carbon (C) and hydrogen (H). The usual, classical fuels are different mixtures of liquid hydrocarbon compounds, hence no specific structural formula can be provided for any of the commercially available fuels. The distinctive features of hydrocarbons are defined essentially by their molecular structure. Their physical properties include electric conductivity.

Oxygen contained in the air is an essential condition of fuel combustion. In practice, air is not an electric conductor, but it can be ionised.

This is where the equipment according to the present invention plays an important role. The targeted objective is to improve mix formation, i.e. create a more homogenous mixture, significantly improving thereby the quality of combustion taking place in the cylinder area, with the direct consequence of boosting performance and hence also reducing fuel consumption, by oxidising/utilising a higher percentage share of the fuel input to the cylinder area. That is to say that more perfect combustion releases more energy per unit quantity of fuel, that is, the same motor vehicle will be able to cover a longer distance with the same amount of fuel. Hence fuel consumption is reduced through efficiency enhancement. Another important result of raising the proportion of fuel combusted in the combustion chamber is the reduction of the amount of non-combusted fuel (HC) released into the environment and, thanks to more perfect combustion, the significant reduction of the most dangerous emission component, viz. carbon monoxide (CO).

If the attraction power between molecules and atomic particles is enhanced, more oxygen atoms will be able to bond to the fuel molecules, a circumstance exerting a positive influence on the quality of combustion, i.e., improving combustion. An internal combustion engine requires approximately 15 kg air for the combustion of 1 kg of fuel. It is important that, prior to combustion, the largest possible number of oxygen atoms be bonded to the hydrocarbon molecule.

This task was achieved according to patent applications U.S. Pat. Nos. 3,537,829 or 3,761,062 by charging up the particles electrically or, more specifically, by providing them with an opposite electric charge. In the given case, a negative charge to the air particles and a positive one to those of the fuel. Opposite electric charges attract each other, as do the opposite poles (N/S) of a magnet. This significantly improves mixture formation, as instead of mixing at random, air and fuel particles also attract each other through their opposite electric charges and, in accordance with the relevant physical law, particles having a negative and a positive charge, respectively, look for one another, so to say, with the consequence that more oxygen atoms of a smaller size can be bonded to the giant hydrocarbon molecule.

Since the quantity of air passing through the equipment at a fast pace cannot be ionised fully, and the quantity of fuel passing through rapidly cannot be fully charged up, the oxygen atoms of the air and the giant molecules of the fuel—also losing part of their charge in passing—cannot efficiently homogenise in the course of mixture formation and prior to their entry into the explosion chamber.

The objective of the present invention being that the equipment concerned be as efficient as possible, our task was to work out a solution ensuring, on the one hand, that fuel and air passing through the equipment should take up maximum electric charge from the equipment in whatever quantity it passes it, resulting in the more efficient bonding of more oxygen atoms and fuel molecules, and, on the other hand, to improve mixture formation and hence obtain a homogenous mixture in order to achieve perfect combustion.

The author of the present invention solved the task on the one hand by a method reducing emission and fuel consumption in order to enhance combustion in the internal combustion engine, whereas the fuel and air making up the mixture are led through a treatment area characterised by specific physical properties prior to their entry to the combustion chamber of the engine, whereas the air stream is provided, through the application of high voltage, a charge of first polarity and the fuel stream is provided a charge of opposite polarity. This method has been upgraded by vibrating at least one of the air and the fuel stream by a frequency in the ultrasonic range.

According to a preferred embodiment of the proposed method, at least one of the air and the fuel stream is vibrated by a frequency in the ultrasonic range in the same section where the air stream and the fuel stream are charged with opposite polarities. This allows to realise even more efficient charge-up.

According to another preferred embodiment of the proposed method, the vibration is generated by ultrasound generator, a method improving the cost-efficiency of the solution.

According to yet another preferred embodiment of the proposed method, at least one of the air and the fuel stream is vibrated in several, successive and/or parallel sections. This measure allows to multiply the effect achieved by vibration.

In certain specific cases, a preferred embodiment of the invention may be one whereas exclusively either the air stream or the fuel stream is vibrated. This will depend on the structural design ever of the engine.

According to a further preferred embodiment of the proposed method, frequencies in the range of 20-100 kHz, more preferably in the range of 35-45 kHz, will be used for the purpose of vibration. This can be achieved by using simple and cheap parts that are available commercially and operate reliably.

The task was solved, on the other hand, by an equipment reducing emission and fuel consumption in order to enhance combustion in the internal combustion engine, whereas the said equipment contains a first ionising unit providing the air stream with a charge of first polarity and a second ionising unit providing the fuel stream with a charge of opposite polarity. According to our proposal, the equipment including at least one ionising unit is equipped with means vibrating at least one of the air stream and the fuel stream by a frequency in the ultrasonic range.

According to a preferred embodiment, the proposed equipment is fitted with means vibrating both the air stream and the fuel stream.

According to another preferred embodiment of the proposed equipment, the vibrating means is a piezo-electric transducer connected to an ultrasound generator.

According to yet another preferred embodiment, the proposed equipment includes several vibrating means connected in parallel and/or in cascade, a design having proved an effect-enhancing measure.

According to a preferred embodiment of the proposed equipment, the vibrating means is designed as a vibrating means with variable frequency, and/or it is designed as a vibrating means with variable signal amplitude.

Figure 2:
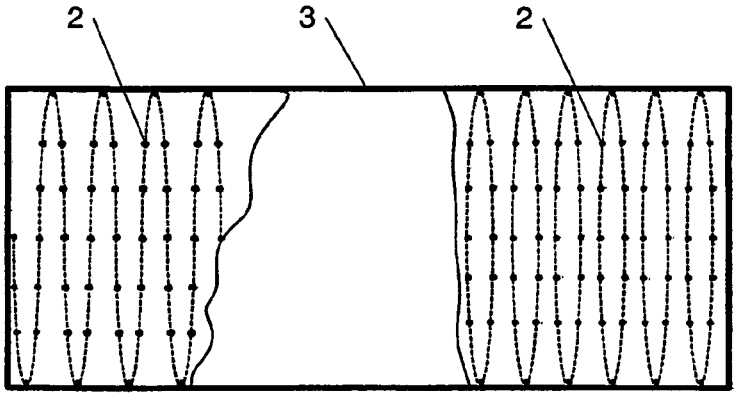
Figure 3:
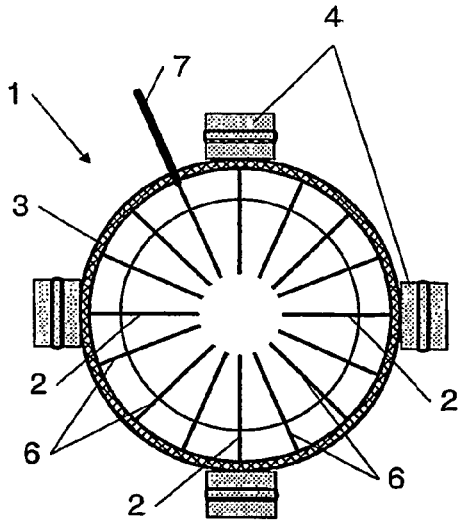
Figure 4:
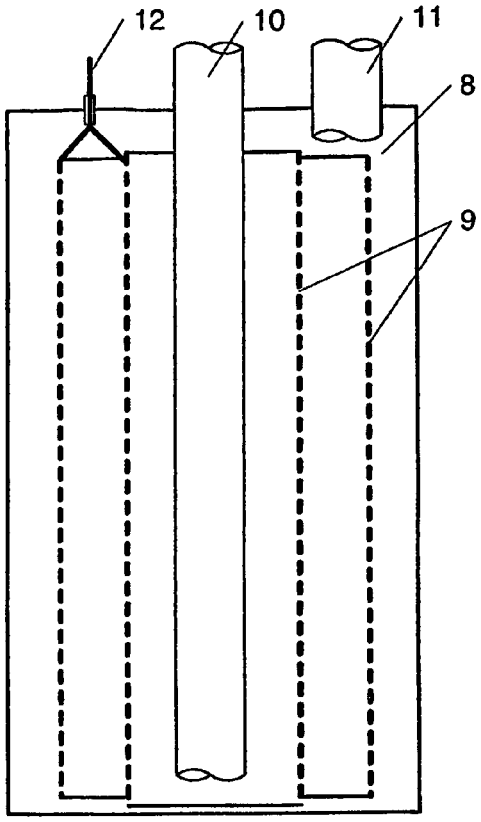
Figure 5:
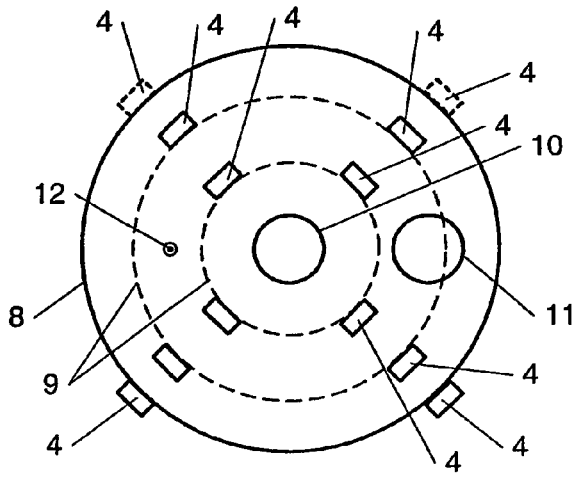
Figure 6:
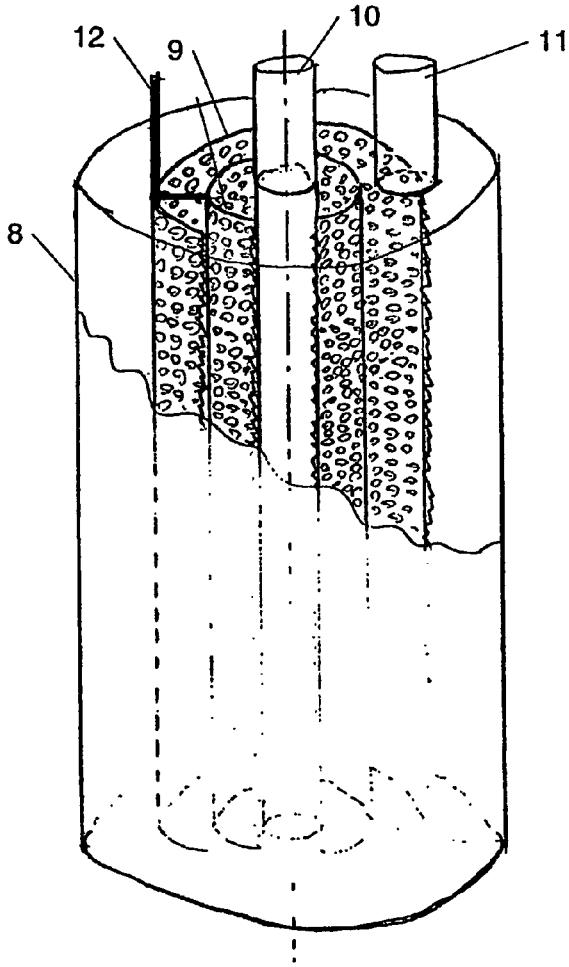
Figure 7:
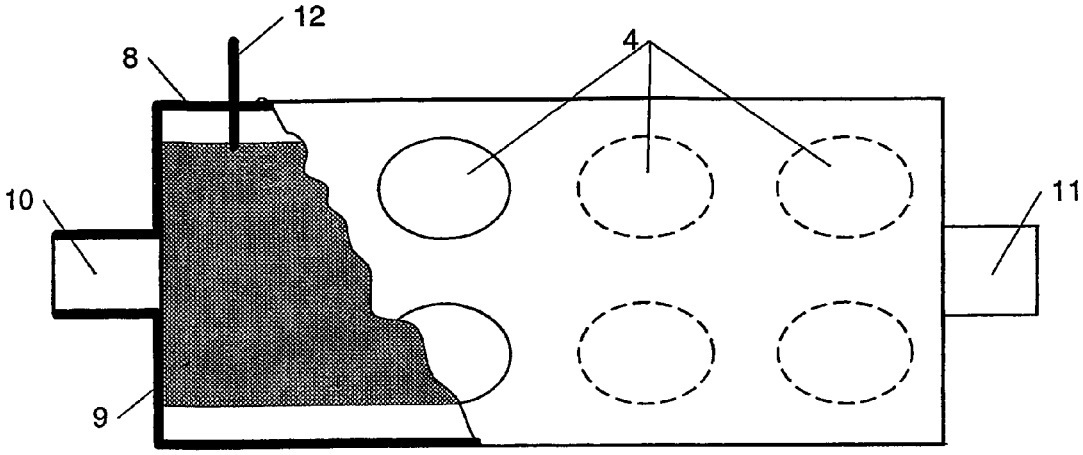
Figure 8:
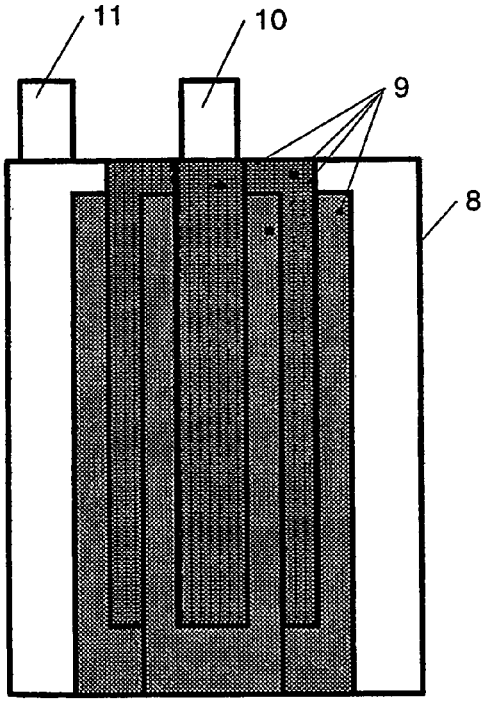
Figure 9:
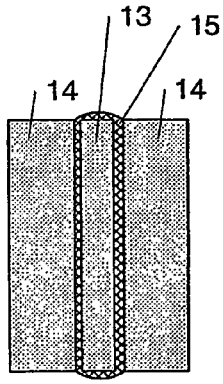

In what follows, we shall describe preferred exemplary embodiments of the proposed method and the equipment realising it with reference to the attached drawing, whereas FIG. 1 shows a possible embodiment of an inlet element of the equipment realising the method according to the present invention, FIG. 2 shows examples of two possible arrangements of the needle electrodes ionising the air stream, FIG. 3 shows the cross-section of the inlet element according to FIG. 1 along line II-II, FIG. 4 shows a possible embodiment of another inlet element of the equipment realising the method according to the present invention, in vertical section, FIG. 5 shows the inlet element according to FIG. 4 in top view, FIG. 6 shows the inlet element according to FIG. 4 axonometrically, in broken section, FIGS. 7, 8 show variants of other inlet element arrangements, and FIG. 9 shows the cross-section of a possible embodiment of the vibration generating element of vibrating means.

FIG. 1 sketches in broken section a metal inlet element 1 fitted into the pipe system supplying air to the combustion chamber of an internal combustion engine, which ionises the air passing through it using high voltage in the way known, as described earlier. The needle electrodes 2, indicated in the figure symbolically as dots, ionising the air can be arranged on superficies 3 either concentrically or along a spiral line, as shown in FIG. 2, or they can be arranged irregularly. Along the circumference of superficies 3 of inlet element 1, cylindrical in the given case, at regular intervals, there are four vibration generating elements 4 fitted in direct physical contact with superficies 3, of which the representation shows the two vibration generating elements 4 on the viewer's side only. It is not of decisive importance that the vibration generating elements 4 be arranged along the circumference, but the experience is that their regular layout enhances the desired effect. Vibration generating elements 4 can be fitted on superficies 3 in several rows, indicated, in FIG. 1, by dotted lines. Inlet element 1 can be fitted, for example, by pipe clamps 5 into the pipe system supplying the air.

FIG. 3 shows the cross-section of inlet element 1 according to FIG. 1. Beside vibration generating elements 4, needle electrodes 2 ionising the air stream—the inner ends of which are in a state of permanent subtle vibration under the effect of the operation of the vibration generating elements—are also clearly visible. As a result of this resonance, resonating electrodes 2 within ionising inlet element 1 move the air in contact with their entire surface in every direction relative to fixed electrodes 6 vibrating to a smaller extent, and focus and condense the already ionised air onto the central line of inlet element 1, giving way, simultaneously, to the incoming, as yet non-ionised, air, ensuring thereby the creation of ion concentration in higher quantity. The figure also shows a connector 7 supplying high voltage to inlet element 1.

FIGS. 4 to 7 sketch a metal inlet element 9 arranged in supplementary tank 8—made preferably of plastic—inserted into the pipe system supplying fuel to the combustion chamber of an internal combustion engine, and ionising the fuel passing through it with the help of high voltage, in the known manner disclosed already. Inlet element 9 can also be arranged parallel with the longitudinal axis of tank 8, but in order to enhance its effect, it is advantageous to select an arrangement ensuring that the fuel be in contact for the longest possible period of time with inlet element 9 functioning as electrode. This can be achieved, for example, by providing fuel inlet 10 and fuel outlet 11 on the same side of tank 8, or by providing several, concentric, inlet elements 9, mounted on the front side of tank 8 labyrinth-like, as indicated in FIG. 8, too. Inlet element 9 shall preferably be made, and is made in the present example, of a perforated aluminium pipe, functioning as electrode, and connected to the high voltage via connector 12 led through tank 8. On the superficies of inlet elements 9, cylindrical in shape in the present example, along the circumference, at regular intervals, there are 4-4 vibration generating elements fitted in direct physical contact with the superficies, indicated in FIG. 5 by unbroken line. By the way, vibration generating elements 4 can be fitted on the superficies of tank 8 also, as shown in FIG. 7, where the representation makes only the two vibration generating elements 4 on the viewer's side visible. It is not of decisive importance that vibration generating elements 4 be placed along the circumference, but the experience is that their regular layout enhances the desired effect in this case, too. Vibration generating elements 4 can be fitted on inlet element 9 in several rows, too, indicated in FIG. 7 by dotted line.

In function of their number, vibration generating elements 4 are attached to the outlet(s) of one or more vibration generating stages. As a result of the permanent subtle resonance generated by vibration generating elements 4, the perforated pipe-shaped inlet element 9, functioning as electrode, shall repel from itself fuel having come into contact with it—and hence charged already, and unable to take up more charge anyway—through the vibration towards outlet 11 of tank 8, mixing more efficiently by the resonance/transferring electric charge to the as yet uncharged fuel particles and, furthermore, making way to the new quantity of fuel supplied to tank 8 via its inlet 10.

Higher ion concentration and more saturated charge of the quantity of fuel involved can also be achieved by inserting two or more ionising inlet elements 1 in series and/or in parallel in the air inlet tube of the engine, in the way of the air, so that active oxygen, i.e., negative ions, be separated from the air particles passing through inlet element 1 and exiting it without any change whatsoever or taking up a minor electric charge, not the maximum amount, in the second or the subsequent inlet elements 1.

The same method shall be pursued in order to ensure that the fuel be fully charged, that is, two or more plastic tanks 8 will be inserted in series and/or in parallel in the fuel supply pipe of the engine, so as to ensure that the quantity of fuel not charged at all or charged in insufficient quantity for the given purpose in the first tank 8 take up more charge in the second or the subsequent tanks 8 with the help of inlet element(s) 9.

Each and every inlet element 1, 9 can be designed as a separate unit. If this is the case, each shall have its own electronic stage generating high voltage as well as its own ultrasound generator.

Any of the known, commercially available, electronic units can be used as ultrasound generator, provided that it has appropriate output parameters and its structure makes it suitable for operation in combination with an internal combustion engine. Such generator unit can be constructed, for example, with the help of the well-known integrated circuit timer of type 555 or the integrated circuit function generator of type 2206, as the shape of the outgoing signal is of no importance either for the effect to be produced or in regard of vibration generating element 3. For this purpose a module called "Ultrasound generator" by CONRAD Elektronic Co., Hirschau, DE, Order No. 130243 can also be used.

The preferred frequency range of the ultrasound generator is limited from above by the fact that, in case of frequencies in excess of around 100 kHz, the effect does not increase proportionally with the energy input required for producing the signal.

FIG. 9 shows an exemplary structure of vibration generating element 4. The central part of the element consists of a piezo-electric transducer 13, operating reversibly, as is well known, that is, transforming the electric signal supplied to it into mechanical vibration. One ceramic tile 14 is fixed, preferably by adhesive bonding, to each of the two sides of piezo-electric transducer 13. Adhesive 15 used for this purpose shall be resistant to the solvent action of the fuel and to high temperatures. The main function of ceramic tiles 14 is to transfer vibration effectively, and to provide mechanical and electric solidity, as vibration generating elements 4 are located directly on perforated pipe inlet element 9 connected to the high voltage source charging up the fuel. In the cases described here, the thickness of piezo-electric transducer 13 is 1-1.5 mm and that of the ceramic tiles 14 is 3-4 mm. Vibration generating element 4 itself is approximately the size of a stamp, in the given example it is a unit measuring 25×25 mm.

If the output power of the ultrasound generator is insufficient for driving the number of vibration generating elements 4 applied, an amplifier stage of a known structure, active in the operating frequency range, shall be installed. As this is quite well-known to those skilled in the art, we shall not describe it here in any detail, and the same goes for the high voltage generating electronic unit.

As for tanks 8 ensuring the fuel supply, it is not to be feared that the high voltage present in each tank 8 separately should add up as a result of their connection in series, as the electrically charged fuel cannot take up more charge in the subsequent tank 8, only the fuel having remained uncharged or insufficiently charged will do so.

Upon the meeting of air and fuel, mixture formation is positively influenced by the spiral arrangement, close to one another, of ionising electrodes 2 in ionising inlet element 1, which are hence capable, beside performing their primary function, to make the air going through them enter the fuel-air mixing area where the mixture is formed already as negative ions, forcefully, in a vortex-like spinning motion, hence resulting in a more homogenous mixture and better combustion in the combustion chamber.

Since shock waves generated by the ultrasound generators accompany both the air and the fuel along their way to mixture formation, at the point of mixture formation, owing to the crossing of the shock waves coming from two directions, on the one hand, the fuel drops split into even smaller particles and hence are able to bond to more oxygen atoms and, on the other hand, the mixture is transformed into a highly homogenous compound, ensuring thereby such an optimal combustion process in the cylinder area as could not be realised without such external intervention.

The solution according to the present invention was tested in a motor car, type Honda CRV, of 2000 $cm^3$ cylinder capacity. Testing included two phases:

1. Measurement of fuel-consumption reduction on public road on a specific route of 100 km, whereas the original fuel tank of the car was removed and replaced by an calibrated measurement cylinder. Testing took place on a motorway, in two different speed ranges, of 80 km/h and 110 km/h, respectively.

Test 1.

| Vehicle speed: 80 km/h, engine revolution per minute: 2450 | | |
|---|---|---|
| Consumption in manufactured state [1/100 km] | Consumption with in-built proposed equipment [1/100 km] | Drop [%] |
| 9.10 | 7.80 | 14.30 |

Test 2.

| Vehicle speed: 110 km/h, engine revolution per minute: 3250 | | |
|---|---|---|
| Consumption in manufactured state [1/100 km] | Consumption with in-built proposed equipment [1/100 km] | Drop [%] |
| 11.92 | 9.04 | 24.17 |

2. Emission (hazardous waste emission) measurement in a service station equipped with calibrated measuring instruments The high voltage of −15,000 V required for the electronics fitted into the air inlet pipe of the car's engine, producing negative charge, and the high voltage of 15,000 V required for the electronics installed in the petrol supply pipe, producing positive charge, were generated by the electric system of the motorcar itself, by voltage inverter well known in the art. The exemplary voltages below are indicative values only: higher voltage shall have a more favourable effect, but as is well-known for those skilled in the art, a compromise must be attained between the effect and security considerations associated with the use of high voltage. According to our experiences, any voltage in the range of 5-100 kV is applicable. An electronic unit generating high voltage implies a minimal load of approximately 6 W for the electrical system of the motor car, which is less than one third of the load implied by the light sources of the motorcar. Hence the two high-voltage generating electronic units installed in the test car implied a load of 12 W only for the electrical system of the car, a negligible amount considering the fact that the car has a surplus electric capacity of 260 W in addition to that covering the originally built-in current consumer, implying no increase of merit in its fuel consumption.

Test 1

| | Engine RPM: 730 | | |
|---|---|---|---|
| | Manufactured state | With proposed equipment installed | Drop [%] |
| CO [vol %] | 0.04 | 0.03 | 25.00 |
| $CO_2$ [vol %] | 15.30 | 15.30 | 0 |
| $O_2$ [vol %] | 0.07 | 0.05 | 28.58 |
| HC (hexane) [ppm] | 9.00 | 7.00 | 22.23 |
| Lambda | 1.002 | 1.002 | |

Test 2

| | Engine RPM: 2580 | | |
|---|---|---|---|
| | Manufactured state | With proposed equipment installed | Drop [%] |
| CO [vol %] | 0.03 | 0.00 | 100.00 |
| $CO_2$ [vol %] | 15.30 | 15.30 | 0 |
| $O_2$ [vol %] | 0.05 | 0.02 | 60.00 |
| HC (hexane) [ppm] | 12.00 | 4.00 | 66.67 |
| Lambda | 1.001 | 1.000 | |

Both the public road consumption and the emission measurement results unambiguously show the efficiency of the equipment reducing emission and fuel consumption. Given the variation options offered by the equipment, the results can be increased further for any internal combustion Otto, diesel and Wankel engine driven by liquid hydrocarbon.

The equipment includes no moving parts, requires no special care and maintenance, and its life-time is identical with that of the electronic parts in any car. It can be manufactured in series at low cost.

The above exemplary embodiments of the invention are meant exclusively to facilitate the better understanding of the essence of the invention, and neither is the scope of the patent specification defined under the claims restricted to these examples. Those skilled in the art shall be able to work out, on the basis of the above guidelines, numerous versions and modifications without exiting the scope of the patent specification. Hence, for example, vibration frequency and/or amplitude can be altered dynamically in the course of the operation of the internal combustion engine, in view of the RPM or load of the engine, with the help, of course, of a controllable ultrasound generator and a control stage monitoring the engine parameters ever, which are technically well-known units.

The invention claimed is:

1. A method for reducing emission and fuel consumption in order to improve combustion in internal combustion engines, comprising the steps of:

preparing a mixture of fuel and air;

forwarding said mixture into a combustion chamber of the internal combustion engine;

guiding, in order to achieve perfect combustion, said mixture through a chamber acting as a treatment area having specific physical properties prior to its entry into the combustion chamber;

applying, within said treatment area, high voltage via one or more electrodes to the air stream to provide a charge of first polarity of the air stream;

applying high voltage via one or more electrodes to the fuel stream to provide a charge of opposite polarity of the fuel stream;

generating an ultrasonic vibration in the air stream by mechanically vibrating said one or more electrodes with a frequency in the ultrasonic range, thereby focussing and compressing the already charged air stream into a central zone of said chamber giving way, simultaneously, to the incoming, as yet non-charged, air stream, ensuring thereby the creation of ion concentration in higher quantity; and generating an ultrasonic vibration in the fuel stream by mechanically vibrating said one or more electrodes with a frequency in the ultrasonic range, thereby releasing the fuel stream already charged from the one or more electrodes towards an outlet of said chamber, and mixing more efficiently by the resonance and transferring electric charge to the as yet uncharged fuel stream and making way to a new fuel stream supplied to the chamber.

2. A method according to claim 1, wherein the at least one of the air stream and the fuel stream is vibrated in several successive and/or parallel sections.

3. A method according to claim 1, wherein the air stream and the fuel stream is vibrated with a frequency within the range of 20 to 100 kHz, more preferably in the range of 35 to 45 kHz.

4. An equipment reducing emission and fuel consumption in order to enhance combustion in the internal combustion engine, the equipment comprising:

a first ionizing unit providing the air stream with a charge of first polarity, said first ionizing unit comprises an ionizing chamber inserted in the path of the air stream transported to a combustion chamber of the internal combustion engine and one or more high-voltage electrodes providing the air stream with a charge of first polarity;

a second ionizing unit providing the fuel stream with a charge of opposite polarity, said second ionizing unit comprises an ionizing chamber inserted in the path of the fuel stream transported to a combustion chamber of the internal combustion engine and one or more high-voltage electrodes providing the fuel stream with a charge of opposite polarity;

a first vibrating means being attached to said ionizing chamber of said first ionizing unit, mechanically vibrating said one or more electrodes within said chamber with a frequency in the ultrasonic range, thereby focussing and compressing the already charged air stream into a central zone of said chamber giving way, simultaneously, to the incoming, as yet non-charged, air stream, ensuring thereby the creation of ion concentration in higher quantity; and a second vibrating means being attached to said ionizing chamber of said second ionizing unit, mechanically vibrating said one or more electrodes within said chamber with a frequency in the ultrasonic range, thereby releasing the fuel stream already charged from one or more electrodes towards an outlet of said chamber, and mixing more efficiently by the resonance and transferring electric charge to the as yet uncharged fuel stream and making way to a new fuel stream supplied to the chamber.

5. An equipment according to claim 4, wherein said vibrating means are a piezo-electric transducer connected to an ultrasound generator.

6. An equipment according to claim 4 comprising, several vibrating means being cascaded and/or connected in parallel.

7. An equipment according to claim 4, comprising vibrating means with variable frequency, and/or with variable signal amplitude.

* * * * *

UNITED STATES PATENT AND TRADEMARK OFFICE

CERTIFICATE OF CORRECTION

PATENT NO. : 7,603,991 B2
APPLICATION NO. : 10/562364
DATED : October 20, 2009
INVENTOR(S) : Peter Rozim It is certified that error appears in the above-identified patent and that said Letters Patent is hereby corrected as shown below:

Title Page, Item (57) - Lines 1-11 of the ABSTRACT - Please delete the duplicate entry "A method .... in given cases in several, succ" before "A method and an"

Signed and Sealed this

Twenty-second Day of December, 2009

David J. Kappos

David J. Kappos
*Director of the United States Patent and Trademark Office*